US010279873B2

(12) United States Patent
Logosz

(10) Patent No.: US 10,279,873 B2
(45) Date of Patent: May 7, 2019

(54) ASSISTED FOIL FOR WATERCRAFT

(71) Applicant: Tony Logosz, Hood River, OR (US)

(72) Inventor: Tony Logosz, Hood River, OR (US)

( * ) Notice: Subject to any disclaimer, the term of this patent is extended or adjusted under 35 U.S.C. 154(b) by 21 days.

(21) Appl. No.: 15/732,416

(22) Filed: Nov. 7, 2017

(65) Prior Publication Data

US 2018/0127067 A1 May 10, 2018

Related U.S. Application Data

(60) Provisional application No. 62/497,055, filed on Nov. 7, 2016.

(51) Int. Cl.

| | |
|---|---|
| ***B63B 35/79*** | (2006.01) |
| *B63H 21/17* | (2006.01) |
| *B63H 11/12* | (2006.01) |
| *B63H 11/08* | (2006.01) |
| *B63J 99/00* | (2009.01) |

(52) U.S. Cl.

CPC ..... *B63B 35/7926* (2013.01); *B63B 35/7943* (2013.01); *B63H 11/08* (2013.01); *B63H 11/12* (2013.01); *B63H 21/17* (2013.01); *B63H 2011/081* (2013.01); *B63J 2099/006* (2013.01)

(58) Field of Classification Search

CPC ... B63B 35/7926; B63B 35/7943; B63B 1/24; B63H 11/08

See application file for complete search history.

(56) References Cited

U.S. PATENT DOCUMENTS 3,465,704 A * 9/1969 Baker ..... B63B 1/244 114/276
3,722,450 A * 3/1973 Arimura ..... B63B 1/28 114/280
4,178,871 A * 12/1979 Hirsch ..... G05D 1/0077 114/275
4,389,195 A * 6/1983 Sohaei ..... B63H 1/36 440/15
4,756,265 A * 7/1988 Lane ..... B63B 1/24 114/274
4,862,820 A * 9/1989 Guezou ..... B63B 1/288 114/278
4,914,945 A * 4/1990 Nakamura ..... G01P 5/14 73/182
4,962,718 A * 10/1990 Gornstein ..... B63H 23/18 114/274
5,117,776 A * 6/1992 Thorpe ..... B63B 1/30 114/274
5,136,961 A * 8/1992 Follett ..... B63B 1/248 114/274
5,448,963 A * 9/1995 Gallington ..... B63B 1/24 114/274
5,590,908 A * 1/1997 Carr ..... A63C 5/03 280/14.21
5,653,189 A * 8/1997 Payne ..... B63B 1/28 114/274
5,934,218 A * 8/1999 Chen ..... B63B 1/042 114/288

(Continued)

*Primary Examiner* — S. Joseph Morano
*Assistant Examiner* — Jovon E Hayes

(57) ABSTRACT

A hydrofoil watercraft has propulsion system integrated with the hull that engages the water when the watercraft is in a displacement mode. The propulsion system is disengaged from the water when the hull is in foiling mode. The propulsion system may automatically deactivate when the watercraft transitions from the displacement mode to the foiling mode.

9 Claims, 1 Drawing Sheet

(56) References Cited

U.S. PATENT DOCUMENTS 5,988,097 A * 11/1999 Karney ..... B63B 1/22 114/283
6,019,059 A * 2/2000 Kelsey ..... B63B 1/28 114/274
6,672,234 B2 * 1/2004 Osmundsvaag ..... B63B 1/042 114/67 A
6,855,016 B1 * 2/2005 Jansen ..... B63H 16/14 440/27
7,047,901 B2 * 5/2006 Chen ..... B63B 1/246 114/274
7,063,031 B2 * 6/2006 Earl, Jr. ..... B63B 1/28 114/162
7,144,285 B1 * 12/2006 Hendricks ..... B63B 1/24 441/74
7,232,355 B2 * 6/2007 Woolley ..... B63B 1/248 114/253
8,166,898 B2 * 5/2012 Chen ..... B63B 35/7923 114/281
8,636,552 B2 * 1/2014 Braden ..... B63H 21/17 440/6
9,359,044 B2 * 6/2016 Langelaan ..... B63H 21/17
9,789,935 B1 * 10/2017 Aguera ..... B63B 35/7926
10,099,754 B2 * 10/2018 Tian ..... B63B 35/7943
2002/0056408 A1 * 5/2002 Dec ..... B63B 35/7943 114/55.56
2002/0072285 A1 * 6/2002 Jung ..... B63B 35/7943 441/74
2002/0124783 A1 * 9/2002 Dynes ..... B63B 1/285 114/55.54
2003/0167991 A1 * 9/2003 Namanny ..... B63B 35/7926 114/55.56
2004/0139905 A1 * 7/2004 Chen ..... B63B 1/246 114/274
2005/0109258 A1 * 5/2005 Smith ..... B63B 1/24 114/274
2007/0283865 A1 * 12/2007 Railey ..... B63B 35/7943 114/55.58
2013/0059489 A1 * 3/2013 Vlock ..... B63B 7/085 440/6
2015/0104985 A1 * 4/2015 Langelaan ..... B63H 21/17 440/6
2018/0072383 A1 * 3/2018 Montague ..... B63B 1/246

* cited by examiner

ASSISTED FOIL FOR WATERCRAFT

CROSS-REFERENCE TO RELATED APPLICATION

This application claims priority and benefit of U.S. Provisional Patent Application No. 62/497,055, filed on Nov. 7, 2016, entitled "ASSISTED FOIL FOR WATERCRAFT," which is incorporated herein by reference in its entirety, and of U.S. Provisional Patent Application No. 62/600,269, filed on Feb. 17, 2017, entitled "WATERCRAFT WITH POWER ASSIST."

FIELD OF THE PRESENT DISCLOSURE

This disclosure generally relates to use of a hydrofoil with a watercraft, such as a surfboard, windsurf board, kite board, or the like. More particularly, the watercraft is configured to provide a propulsion assist while the hull of the watercraft is in a displacement mode.

BACKGROUND

Hydrofoils are wings that are adapted to function in water as opposed to air, but share many similar attributes. Notably, a hydrofoil provides a significant amount of lift, even at relatively slow speeds. Accordingly, the benefits of a hydrofoil may be extended to any number of applications involving movement through the water. For example, nearly any recreational pursuit that involves riding a board may take advantage of a hydrofoil, including kitesurfing, wind surfing, stand up paddle boarding, wake boarding, water skiing, tow-in surfing, conventional surfing and others.

An important characteristic associated with a hydrofoil-equipped craft is the concept of a threshold speed. Below this speed, the hydrofoil is unable to generate the lift necessary to suspend the hull of the craft, such as a surfboard, above the water. Consequently, in addition to whatever friction is attributed to the hydrofoil, the hull displaces water and presents a significant amount of surface area to the water. Both aspects dramatically increase the drag experienced by the craft. However, above the threshold speed, the hydrofoil generates sufficient force to lift the hull of the craft free from the water surface, a condition typically termed "flying." This takes all drag components associated with the hull out of the equation, leaving only the hydrofoil friction, which is relatively unchanged. Due to the significant reduction in drag, much less force is required to keep the craft at or above the threshold speed than may be required to accelerate the craft to the threshold speed. This phenomenon is similar to the transition of a hull from a displacement mode to a planning mode, when a reduced surface area of the hull is able to "skip" across the water. While readily appreciated in any number of sports, it is magnified here given the greater efficiency of the hydrofoil. The techniques of this disclosure facilitate attaining the threshold speed as will be appreciated in view of the following discussion.

SUMMARY

As will be described in detail below, this disclosure includes a watercraft having a hull, a hydrofoil configured to suspend the hull above a water surface when a threshold speed is exceeded, and a propulsion system integrated with the hull. The propulsion system engages the water when the watercraft is in a displacement mode and the propulsion system is disengaged from the water when the hull is in foiling mode.

In one aspect, the propulsion system may automatically deactivate when the hull transitions from displacement mode to foiling mode. A water contact sensor may determine when the hull is in displacement mode. A speed sensor may determine when the hull is in foiling mode.

In one aspect, the watercraft may have a control system that allows a user to selectively activate the propulsion system.

This disclosure also includes a method of propelling a watercraft across water. The method may involve providing a watercraft having a hull, a hydrofoil configured to suspend the hull above a water surface when a threshold speed is exceeded, and a propulsion system integrated with the hull that engages the water when the watercraft is in a displacement mode, wherein the propulsion system is disengaged from the water when the hull is in a foiling mode. The propulsion system may be activated when the watercraft is in the displacement mode below a threshold speed and may be deactivated when the watercraft is in the foiling mode above a threshold speed.

In one aspect, deactivation of the propulsion system may occur automatically when the watercraft is in the foiling mode. The method may involve sensing when the watercraft is in the displacement mode and/or when the watercraft is in the foiling mode.

DETAILED DESCRIPTION

Figure 1:
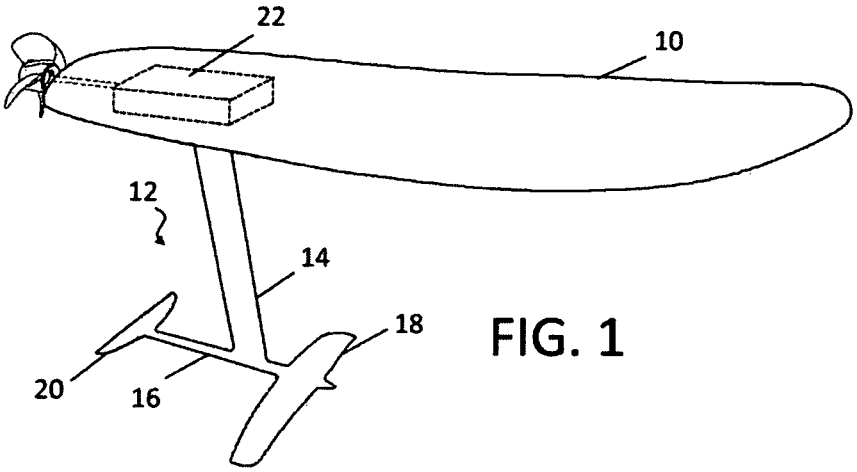
FIG. 1 is schematic diagram of a watercraft having a hydrofoil assisted with a propulsion system according to an embodiment.

At the outset, it is to be understood that this disclosure is not limited to particularly exemplified materials, architectures, routines, methods or structures as such may vary. Thus, although a number of such options, similar or equivalent to those described herein, can be used in the practice or embodiments of this disclosure, the preferred materials and methods are described herein.

It is also to be understood that the terminology used herein is for the purpose of describing particular embodiments of this disclosure only and is not intended to be limiting.

The detailed description set forth below in connection with the appended drawings is intended as a description of exemplary embodiments of the present disclosure and is not intended to represent the only exemplary embodiments in which the present disclosure can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the specification. It will be apparent to those skilled in the art that the exemplary embodiments of the specification may be practiced without these specific details. In some instances, well known structures and devices are shown in block diagram form in order to avoid obscuring the novelty of the exemplary embodiments presented herein.

For purposes of convenience and clarity only, directional terms, such as top, bottom, left, right, up, down, over, above, below, beneath, rear, back, and front, may be used with respect to the accompanying drawings or chip embodiments. These and similar directional terms should not be construed to limit the scope of the disclosure in any manner.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Unless defined otherwise, all technical and scientific terms used herein have the same meaning as commonly understood by one having ordinary skill in the art to which the disclosure pertains. Finally, as used in this specification and the appended claims, the singular forms "a, "an" and "the" include plural referents unless the content clearly dictates otherwise.

Given the context of the threshold speed discussed above, many situations exist in pursuits involving watercraft where an attempt is made to harness a propulsive power to drive past the threshold speed. A surfer may paddle to catch a wave, a kite boarder may dive the kite, or a windsurfer may "pump" the sail to generate a transient increase in force sufficient to exceed the threshold speed. Having done so, a baseline, reduced amount of force is sufficient to keep the craft moving above the threshold speed without supplementation. With regard to the above examples, the surfboard uses the power of the wave and the kite boarder/windsurfer uses the force of the wind in the kite/sail to maintain the necessary speed. Considering the dramatic efficiencies of a hydrofoil craft, there are many situations where a user could exploit wind and water conditions to maintain the craft above the threshold speed if there were a convenient way to provide the transient supplemental propulsive force. As an illustration only, stand up paddleboarders may try to catch wind driven swells or the wake of a passing vessel. With a hydrofoil, much less amplitude is required for the swell or wake to impart enough force to maintain the threshold speed. However, there is still the requirement to reach the threshold speed dictated by the characteristics of the hydrofoil, the watercraft and the environmental conditions. It may be difficult to paddle sufficiently hard, or even if possible, the user may quickly exhaust themselves. The techniques of this disclosure are directed to providing the necessary transient propulsive force as a supplement to exceed the threshold speed. In some applications, this may be used to augment other propulsive force(s), such as may be generated by paddling, by waves or other water conditions, by wind, or others.

To help illustrate aspects of the disclosure, reference is made to FIG. 1, which shows one embodiment of a watercraft 10 that may be equipped with a hydrofoil 12. Again, virtually any craft that may be ridden or propelled through water may benefit from these techniques. As shown in greater detail, hydrofoil 12 generally includes a mast 14 that extend from the watercraft 10 (not shown in this view) to a fuselage 16. The length of mast 14 may be varied to alter handling characteristics as known in the art. Generally, a longer mast allows for the board to be lifted relatively higher from the surface of the water when the hydrofoil is "flying" and generating sufficient lift. As a result, the board is isolated from the surface conditions, including chop and other disturbances. However, a longer mast may be more difficult to control for the rider, such that a relatively shorter mast be beneficial, particularly for those learning. In turn, a fore wing 18 and an aft wing 20 may be mounted to the fuselage. As implied by the names, the fore and aft wings provide the lift generated by hydrofoil 12. Many different designs and/or configurations of wings may be employed, any of which may be utilized when implementing the techniques of this disclosure.

Attempts have been made in the prior art to provide powered, hydrofoil craft for personal use or recreational pursuits. However, these approaches have all involved generating the propulsive force through the hydrofoil, such as by driving a propeller or the like. Consequently, the propulsion system is always engaged with the water and must be continuously driven while the hydrofoil is flying. If these conventional systems were not being driven, the parasitic drag of the propulsion system would significantly degrade the performance and significantly increase the amount of force necessary to maintain the threshold speed. Conversely, the techniques of this disclosure involve a propulsion system 22 that is associated with the hull or board, as schematically illustrated in FIG. 1, such as a propeller driven by a rechargeable battery powered electric motor as depicted.

In use, the propulsion system 22 engages with the water when the craft 10 is below the threshold speed and the hull is in displacement mode. Engagement of propulsion system 22 may include submerging all or a portion of a propeller, jet or the like. In general, engagement of propulsion system 22 means that a substantial amount of thrust developed is directed directly to the water. Either alone, or in conjunction with another suitable source of propulsive power (e.g., wind, paddle, water), the propulsion system 22 is used to accelerate watercraft 10 when the hull is in displacement mode. When watercraft 10 reaches the threshold of foiling speed, hydrofoil 12 generates sufficient lift to "fly," and the hull may be considered to be in foiling mode. Propulsion system 22 is configured to be disengaged from the water when the hull is in foiling mode. Correspondingly, disengagement of propulsion system 22 from the water is associated with the propeller, jet or other mechanism that develops thrust being out of the water. At this stage, since hydrofoil 12 is suspending the hull of the craft 10 above the water as described above, a dramatic decrease in friction is experienced and the craft 10 may exploit whatever conditions exist to maintain the threshold speed (riding a swell, harnessing the wind, or the like). With the supplemental propulsive force no longer required to maintain watercraft 10 at or above the threshold speed, the propulsion system 22 may be configured to automatically depower or deactivate at the threshold speed or when the hull of watercraft 10 is no longer in displacement mode, or both.

The propulsion system 77 may be implemented wing any existing, conventional technology. Without limitation, any type of propeller or jet based system may be used as desired, and may be powered using an appropriate fuel, such as gasoline or hydrogen, as well as other sources of power including electricity or compressed air. A number of suitable mechanisms have been developed for powering watercraft that do not employ hydrofoils, including powered surfboards for example. Such systems may be adapted for use with the techniques of this disclosure with the understanding that the necessary power reserves may be substantially reduced, given that the propulsion system 22 will be used only intermittently rather than continuously. In some embodiments, the propulsion system 22 may be powered by a rechargeable energy source. Further, the rechargeable energy source may be recharged during use, such as by a human powered generator to provide electricity or a pump to compress air.

Notably, the propulsion system may be designed to automatically deactivate when the threshold speed is reached. This may be attributed, at least in part, to the design of the propulsion system 22. For example, jet-based propulsion may require a water intake. If the intake is positioned on the hull of the craft 10, when the hull lifts free of the water, supply to the intake will be cut off, deactivating the system. In other embodiments, a suitable sensor may be used to determine when the threshold speed has been reached, such as by determining when the hull is no longer in contact with water via a pressure switch or any other suitable mechanism. In yet other embodiments, a speed sensor may be employed to determine when hydrofoil 12 is in a flying condition, based at least in part, on the performance characteristics of hydrofoil 12 and watercraft 10. Alternatively, the propulsion system 22 may be operated by remote control by the user, allowing the user to selective activate and deactivate as desired.

Figure 2:
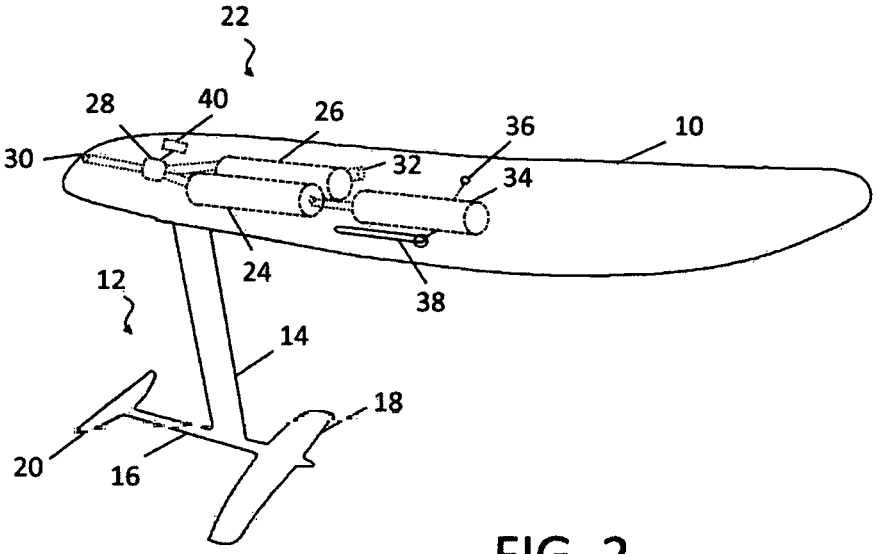
FIG. 2 is schematic diagram of a hydrofoil watercraft having a compressed air propulsion system according to an embodiment.

To help illustrate, one exemplary embodiment of propulsion system 22 is schematically depicted in FIG. 2 for watercraft 10. As shown, propulsion system 22 may generally include a series of interconnected components, including compressed air supply 24 and water reservoir 26. Mixer 28 combines the air and water in a desired ratio and ejects the resulting compressed air and water mixture through nozzle 30 that may be located at the rear of watercraft 10 or in any other suitable location configured to generate thrust in the forward direction. In some embodiments, the ratio of air and water may be adjustable to alter the thrust characteristics of the jet that is produced. Water reservoir 26 may be resupplied through one-way valve 32 that is located below the waterline of watercraft 10 when in displacement mode.

The depicted embodiment employs a two-stage compressed air delivery system. To that end, air supply 24 may be fed by compressed air reservoir 34. In a two-stage system, compressed air reservoir 34 may, at least initially, be charged with air stored at a relatively high pressure. During use, air supply 24 may be charged to a lower, working pressure. When the jet propulsion is activated, the air from air supply 24 may be discharged for mixing with water, providing a power boost that may be sustained for the length of time it takes to discharge. Once exhausted, air supply 24 may be recharged from compressed air reservoir 34, enabling another period of propulsion. Air supply 24 may be recharged as many times as allowed given the relative storage and working pressures and the respective volumes of the air supply 24 and compressed air reservoir 34. Conversely, embodiments that employ a one-stage system may omit the compressed air reservoir 34, so that the only compressed air storage integrated into watercraft 10 is represented by the volume of air supply 24.

Filling and/or refilling compressed air reservoir 34 (in two-stage embodiments) or air supply 24 (in one-stage embodiments) may be accomplished in any suitable manner, depending on the configuration and desired performance characteristics. For clarity, the following examples are described in the context of compressed air reservoir 34, but may readily be applied to air supply 24 as warranted. For example, compressed air reservoir 34 may be filled with compressed air at a relatively high pressure before use with an air compressor or the like through intake valve 36. Alternatively or in addition, an external source of compressed air, such as a carbon dioxide canister, may be threaded to intake valve 36. Also alternatively or in addition, a hand pump 38 may be provided allowing the user to recharge compressed air reservoir 34 while watercraft 10 is in use.

The user may selectively activate mixer 28 through control module 40, to open valves to air supply 24 and water reservoir 26 to form a jet to be ejected through nozzle 30. As noted, in some embodiments, control module 40 may also adjust the ratio of water and air. Control module 40 may be responsive to any desired form of user input for the activation and/or deactivation of mixer 28. For example, voice recognition technologies may be employed, allowing a spoken keyword to be used to trigger a given operation. Voice control allows the user to activate the jet without interrupting other activities, such as performing paddling strokes or other methods of propelling watercraft 10, so that propulsion system 22 may more effectively supplement the action. Alternatively, any suitable remote control configuration may be employed, using wired or wireless technologies. The remote control may be mounted to the board, or worn at a suitable location by the user, such as the wrist, arms or legs. In embodiments where the watercraft is propelled by a separate paddle, such as in stand up paddling or kayaking, the remote control may be integrated into the paddle, in the handle or other suitable location.

In another aspect, propulsion system 22 may be controlled, at least in part, based on the board speed of the watercraft as noted above. Board speed may be determined through motion sensors, such as accelerometers, in control module 40, an electromagnetic or paddlewheel-style sensor mounted on a suitable surface of watercraft 10, or may be determined independently, such as by a GPS system carried or worn by the user, or in any other known manner. For example, a relatively low first speed may be used to activate propulsion system 22. As desired, additional control inputs may be used to fine tune the operation, such as by distinguishing when watercraft 10 is in displacement mode from when hydrofoil 12 is flying and the hull is in foiling mode. When the user paddles or otherwise propels watercraft 10 to the first speed, control module 40 may activate propulsion system 22 to boost the energy supplied by the user to help watercraft 10 attain the threshold speed at which hydrofoil 12 begins to fly. Similarly, a greater cutoff speed may also be used to deactivate propulsion system 22 to conserve the compressed air in air supply 24 and/or air reservoir 34 once watercraft 10 has attained the threshold speed at which hydrofoil 12 is in a flying condition. As described, other techniques may be employed separately or in conjunction to discriminate between when watercraft 10 is in displacement mode and in foiling mode, so that propulsion system 22 is activated (or ready to activate) in displacement mode and deactivate in foiling mode. It will be appreciated that a hybrid control system may also be used, such that the user manually activates propulsion system 22 and a predefined or user adjustable speed is used to deactivate or a similarly established speed activates propulsion system 22 and the user manually deactivates when desired.

While the propulsion system 22 depicted in FIG. 2 is based on compressed air, it should again be recognized that any power mechanism for generating thrust may be used with the techniques of this disclosure, such as those employed for powering non-hydrofoil watercraft. For example, gasoline-powered jet engines have been developed for surfboard-like watercraft. Other technologies include electric motors powered by rechargeable batteries that may be used to drive impellers or propellers. In contrast to these noted examples, the techniques of this disclosure need not be employed continuously, but rather transiently to assist the transition from below foiling speed to above foiling speed. Correspondingly, the requirements for power reserves or overall thrust are significantly reduced. Further, depending on the application, the techniques may be used to augment other forms of propulsion rather than being required to provide the sole source of movement.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the present invention.

What is claimed is:

1. A watercraft for travel across water, comprising a hull, a hydrofoil configured to suspend the hull above a water surface when a threshold speed is exceeded, and a propulsion system integrated with the hull that engages the water when the watercraft is in a displacement mode, wherein the propulsion system is disengaged from the water when the hull is in foiling mode and wherein the propulsion system consists essentially of a single system that is configured for use only when the single system is engaged with the water.

2. The watercraft of claim 1, wherein the propulsion system is configured to automatically deactivate when the hull transitions from displacement mode to foiling mode.

3. The watercraft of claim 2, further comprising a water contact sensor to determine when the hull is in displacement mode.

4. The watercraft of claim 2, further comprising a speed sensor to determine when the hull is in foiling mode.

5. The watercraft of claim 1, further comprising a control system configured to allow a user to selectively activate the propulsion system.

6. A method of propelling a watercraft across water, comprising:

providing a watercraft having a hull, a hydrofoil configured to suspend the hull above a water surface when a threshold speed is exceeded, and a propulsion system integrated with the hull that engages the water when the watercraft is in a displacement mode, wherein the propulsion system is disengaged from the water when the hull is in a foiling mode and wherein the propulsion system consists essentially of a single system that is configured for use only when the single system is engaged with the water;

activating the propulsion system when the watercraft is in the displacement mode below a threshold speed; and deactivating the propulsion system when the watercraft is in the foiling mode above a threshold speed.

7. The method of claim 6, wherein the deactivation of the propulsion system occurs automatically when the watercraft is in the foiling mode.

8. The method of claim 7, further comprising sensing when the watercraft is in the displacement mode.

9. The method of claim 7, further comprising sensing when the watercraft is in the foiling mode.

* * * * *